US011020838B2

(12) United States Patent
Baurceanu et al.

(10) Patent No.: US 11,020,838 B2
(45) Date of Patent: Jun. 1, 2021

(54) ONE OR MORE CONFORMAL MEMBERS USED IN THE MANUFACTURE OF A LAPPING PLATE, AND RELATED APPARATUSES AND METHODS OF MAKING

(71) Applicant: Seagate Technology LLC, Cupertino, CA (US)

(72) Inventors: Mihaela Ruxandra Baurceanu, Edina, MN (US); Chea Phann, Woodbury, MN (US); Kevin Lamber Mayer, Apple Valley, MN (US); Ricky Ray Anderson, Bloomington, MN (US); Andrew David Habermas, Bloomington, MN (US)

(73) Assignee: Seagate Technology LLC, Fremont, CA (US)

( * ) Notice: Subject to any disclaimer, the term of this patent is extended or adjusted under 35 U.S.C. 154(b) by 401 days.

(21) Appl. No.: 15/693,837

(22) Filed: Sep. 1, 2017

(65) Prior Publication Data

US 2019/0070709 A1 Mar. 7, 2019

(51) Int. Cl.

| | |
|---|---|
| ***B24B 53/017*** | (2012.01) |
| ***B24B 53/12*** | (2006.01) |
| ***B24B 37/12*** | (2012.01) |
| ***B24B 37/20*** | (2012.01) |
| ***B24B 27/00*** | (2006.01) |

(52) U.S. Cl.

CPC ..... *B24B 53/017* (2013.01); *B24B 27/0076* (2013.01); *B24B 37/12* (2013.01); *B24B 37/20* (2013.01); *B24B 53/12* (2013.01)

(58) Field of Classification Search

CPC ..... B24B 53/017; B24B 53/02; B24B 53/12; B24B 53/14; B24B 37/12; B24B 37/20; B24B 27/0076

USPC ..... 451/56, 443, 550

See application file for complete search history.

(56) References Cited

U.S. PATENT DOCUMENTS

| | | | | |
|---|---|---|---|---|
| 5,910,041 | A | 6/1999 | Duescher | |
| 6,585,559 | B1 | 7/2003 | Griffin et al. | |
| 6,602,108 | B2 * | 8/2003 | Griffin | B24B 37/04 451/28 |
| 6,953,385 | B2 * | 10/2005 | Singh, Jr. | B24B 37/00 451/28 |
| 8,801,497 | B2 * | 8/2014 | Schwappach | B24D 11/00 451/28 |
| 9,067,301 | B2 * | 6/2015 | Sung | B24D 3/007 |
| 9,221,148 | B2 * | 12/2015 | Schwappach | B24B 37/048 |
| 9,475,169 | B2 * | 10/2016 | Sung | B24B 49/186 |
| 2004/0203325 | A1 * | 10/2004 | Donohue | B24B 53/017 451/56 |
| 2010/0279586 | A1 | 11/2010 | Schwappach | |
| 2011/0104989 | A1 * | 5/2011 | Boutaghou | B24B 37/14 451/28 |

(Continued)

OTHER PUBLICATIONS

Phann et al., U.S. Appl. No. 15/198,566, filed Jun. 30, 2016.

*Primary Examiner* — Eileen P Morgan

(74) *Attorney, Agent, or Firm* — Kagan Binder, PLLC

(57) ABSTRACT

The present disclosure includes one or more resilient members for use in an apparatus used to form lapping plates. The resilient members can permit processing members such as charging elements and shaving blades to conform to irregularities in surface topography of lapping plate platens.

20 Claims, 6 Drawing Sheets

(56) References Cited

U.S. PATENT DOCUMENTS

| | | | | |
|---|---|---|---|---|
| 2011/0159784 | A1 | 6/2011 | Boutaghou et al. | |
| 2012/0149283 | A1* | 6/2012 | Schwappach ..... | B24D 11/00 451/28 |

* cited by examiner

ONE OR MORE CONFORMAL MEMBERS USED IN THE MANUFACTURE OF A LAPPING PLATE, AND RELATED APPARATUSES AND METHODS OF MAKING

BACKGROUND

The present disclosure relates to lapping plates and methods of making lapping plates that can be used to lap (abrade) one or more bars of sliders.

SUMMARY

The present disclosure includes embodiments of an apparatus for processing a major surface of a lapping plate platen during the manufacture of an abrasive surface on the major surface of the lapping plate platen, wherein the apparatus includes a rotatable platter and a processing head mechanism. The rotatable platter is configured to secure and physically support the lapping plate platen during processing of the major surface of the lapping plate platen. The processing head mechanism is rotatably and removably coupled to a processing head. The processing head includes a base; at least one resilient member attached to the base; and at least one processing member is attached to the at least one resilient member. The at least one processing member can contact the major surface of the lapping plate platen under pressure to modify the surface of the lapping plate platen during the manufacture of the abrasive surface on the major surface of the lapping plate platen. The at least one resilient member permits the at least one processing member to elastically move in response to a pressure increase while the at least one processing member is in contact the major surface of the lapping plate platen under pressure to modify the surface of the lapping plate platen during the manufacture of the abrasive surface on the major surface of the lapping plate platen. The apparatus is configured to move the processing head in at least the z-axis direction to contact the major surface of the lapping plate platen with the at least one processing member under pressure to modify the surface of the lapping plate platen during the manufacture of the abrasive surface on the major surface of the lapping plate platen.

The present disclosure also includes embodiments of a method of processing a major surface of a lapping plate platen during the manufacture of an abrasive surface on the major surface of the lapping plate platen. The method includes contacting a major surface of the lapping plate platen with at least one processing member under pressure to modify the surface of the lapping plate platen during the manufacture of the abrasive surface on the major surface of the lapping plate platen. The at least one processing member is part of a processing head that includes a base; at least one resilient member attached to the base; and the at least one processing member attached to the at least one resilient member. The at least one resilient member permits the at least one processing member to elastically move in response to a pressure increase while the at least one processing member is in contact the major surface of the lapping plate platen under pressure to modify the surface of the lapping plate platen during the manufacture of the abrasive surface on the major surface of the lapping plate platen. The processing head mechanism is configured to move the processing head in at least the z-axis direction to contact the major surface of the lapping plate platen with the at least one processing member under pressure to modify the surface of the lapping plate platen during the manufacture of the abrasive surface on the major surface of the lapping plate platen.

DETAILED DESCRIPTION

Lapping machines (apparatuses) can be used to perform lapping operations on various substrates such as a bar of sliders. Such lapping machines can use a lapping plate that performs grinding and/or polishing operations on a substrate such as a bar of sliders. Lapping machines can include a rotating lapping plate that defines a lapping surface which can help abrade the surface of a ceramic material such as AlTiC, which is a two phase composite of alumina ($Al_2O_3$) and titanium-carbide (TiC). If desired, a slurry can be applied to the lapping surface to enhance the abrading action as the lapping surface is rotated relative to a slider bar containing a plurality of the sliders held in a pressing engagement against the lapping surface. A lapping plate can be used for a variety of lapping processes such as rough lapping, fine lapping, and kiss lapping.

Embodiments of the present disclosure include an apparatus for processing a major surface of a lapping plate platen during the manufacture of an abrasive surface on the major surface of the lapping plate platen. The apparatus can include a rotatable platter and a processing head mechanism. The rotatable platter can be configured to secure and physically support a lapping plate platen during processing of the major surface of the lapping plate platen. The processing head mechanism can be rotatably and removably coupled to a processing head. The processing head can include a base and at least one processing member coupled to the base.

A variety of exemplary apparatuses can be used for processing a lapping plate platen so as to form a lapping plate. An example of such an apparatus is described in U.S. Pat. No. 6,585,559 (Griffin et al.), wherein the entirety of said patent is incorporated herein by reference. Either a multi-step apparatus can be used or a single-step apparatus can be used.

A "multi-step" apparatus, machine, or tool can be configured to perform multiple processes on a platen so as to form a lapping plate. An example of a multi-step apparatus 100 for processing a major surface of a lapping plate platen during the manufacture of an abrasive surface on the major surface of the lapping plate platen is described below with respect to FIGS. 1, 2, and 3.

Figure 1:
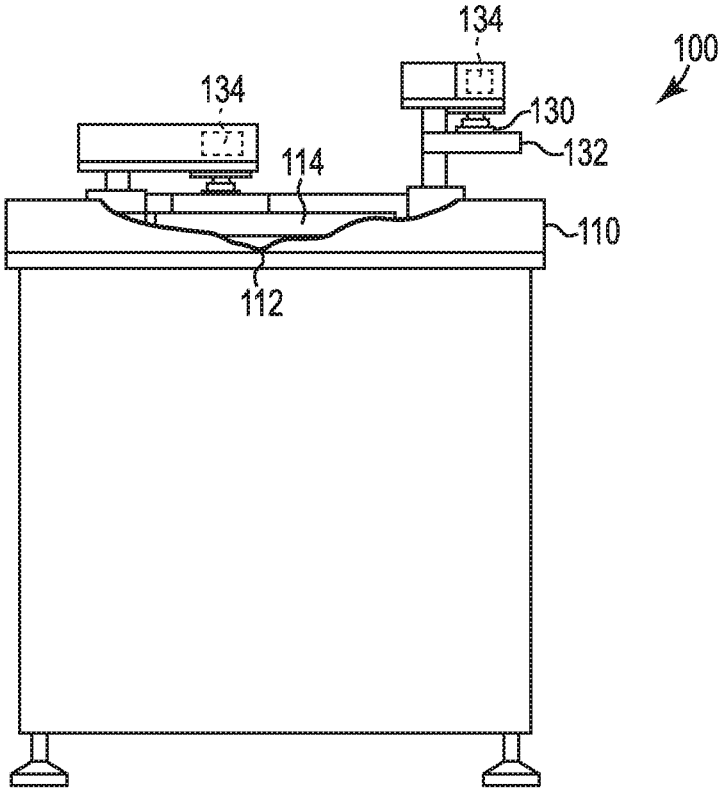
FIG. 1 is a schematic elevation view showing a multi-step apparatus for processing a major surface of a lapping plate platen.

As shown, apparatus 100 includes a base 110. The base 110 can be constructed of rigid or high strength materials. As illustrated in FIG. 1, the base 110 can be mounted on stands, or appropriate support members. As shown, a rotatable platter 112 is rotatably mounted on the base 110. The rotatable platter 112 (or turn table) is configured to secure and physically support the lapping plate platen 114 during processing of the major surface 116 of the lapping plate platen 114 so that it can function as a lapping plate and perform lapping operations. In more detail, the platen 114 includes one or more surfaces 116 (only one shown) that can be used to perform the actual lapping operations. At least the surface 116 of the platen 114 (e.g., the whole platen) can be an alloy made out of one or more metals. Exemplary metals include at least one of tin, tin alloy (e.g., tin/antimony), aluminum, copper, combinations of these, and the like.

Platen 114 can have a wide variety of diameters. In some embodiments, platen 114 can have a diameter in the range from 10 to 20 inches.

A main drive motor (not shown) can be attached to the base 110, and can provide the force to rotate the platter 112 during operation of the apparatus 100 (e.g., counterclockwise as indicated by arrow 143). Also, a spindle assembly (not shown) can be coupled to the main drive motor in order to rotate the platter 112.

An apparatus according to the present disclosure can include one or more liquid dispensers configured to dispense one or more liquid treatment compositions onto the major surface 116 of the lapping plate platen 114. As shown, apparatus 100 includes a dispensing unit 138 mounted on the base 110. The dispensing unit 138 can be configured to dispense controlled quantities of a liquid treatment composition onto the surface 116 of the platen 114. The liquid treatment composition dispensed on the platen 114 can be for example in the form of a lubricant or a liquid containing predetermined concentrations of abrasive particles. The dispensing unit 138 can be configured to dispense a liquid treatment composition in various manners depending on the specific operation being performed. For example, the dispensing unit 138 can be configured to dispense a liquid treatment composition in a drip fashion onto the surface 116. The dispensing unit 138 can be further controlled to either dispense or not dispense a liquid treatment composition for predetermined intervals of time depending on the specific protocol of the operation being performed.

Figure 2:
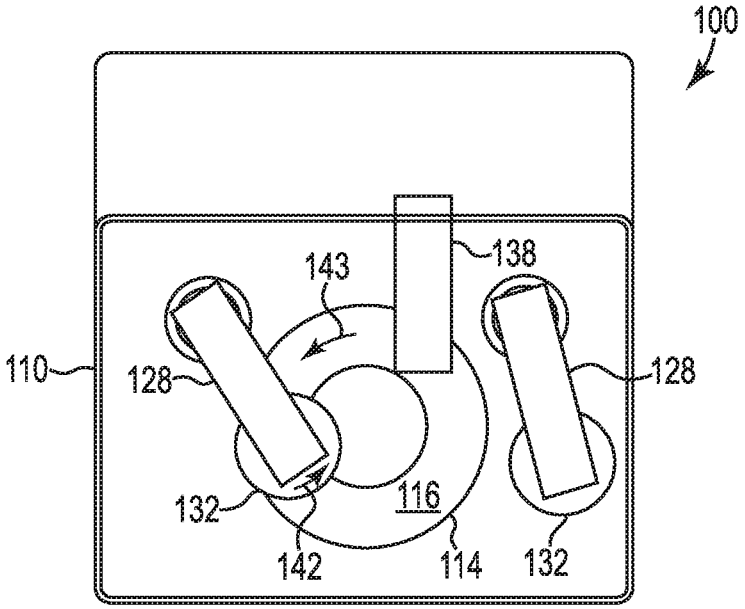
FIG. 2 is a plan view of the apparatus shown in FIG. 1.

As shown, the apparatus 100 includes a pair of arms 128 disposed on the base 110. Although only two arms 128 are illustrated in FIGS. 1 and 2, it should be appreciated that various other configurations are possible. For example, only one arm 128 may be provided, or more than two arms 128 can be provided. As shown, each arm 128 includes a processing head mechanism 130 that can receive the processing head 132 and is rotatably and removably coupled to a processing head 132 so that processing head 132 can gimble. Each processing head 132 is attached to each processing head mechanism 130 for performing operations on the surface 116 of the platen 114. Each processing head mechanism 130 is rotatably mounted to its respective arm 128 so that processing head 132 is capable of rotation. As shown, each arm 128 further includes a spindle motor 134 that controls rotation of the processing head mechanism 130. In some embodiments, the processing head mechanism 130 can be configured with a quick change arrangement that can readily accept a variety of texturizing, shaving, washing, charging, and other processing heads 132. The arms 128 are used (in conjunction with the heads 132) to process (e.g., texturizing, washing, shaving, and charging operations) the platen 114 in preparation for lapping operations.

An actuator (not shown) can be coupled to each arm 128. The actuators can function to place the processing heads 132 in desired alignment with the surface 116 of the platen 114. Accordingly, the actuators are capable of placing the arms 128 in various operating positions. For example, the apparatus 100 can be configured to move the processing head 132 in at least the z-axis direction to contact the major surface 116 of the lapping plate platen 114 with the at least one processing member (not shown) under pressure to modify the surface 116 of the lapping plate platen 114 during the manufacture of the abrasive surface on the major surface of the lapping plate platen 114. As shown in FIG. 2, the processing head mechanism 130 can be placed in a first position wherein at least a portion of the processing head 132 overlies a portion of the surface 116 of the platen 114 when the processing head 132 is in contact with the surface 116. A second position is also shown wherein another processing head 132 has been raised and placed out of alignment with the platen 114 (the processing head 132 is completely outside the perimeter of surface 116). It can be appreciated that the actuators can also be capable of placing the processing heads 132 in any intermediate positions between the two positions illustrated in FIG. 2. By virtue of its mode of operation, the actuators can be controllable for placing the heads 132 in contact with the surface 116 of the platen 114. In some embodiments, one or more predetermined weights (not shown) can be coupled with each arm 128 and head 132 so that a predetermined amount of pressure is applied downward on the head 132 and, therefore, the surface 116 of platen 114 during processing. Alternatively, pneumatic pressure can be used to apply downward pressure on head 132.

A "single-step" apparatus can be configured to perform only a single process on the surface of a platen so as to form a lapping plate. For example, such an apparatus may be substantially similar to apparatus 100 with the exception of having only one arm 128 and one processing head 132.

A processing head 132 can be configured based on a given processing step. In some embodiments, a processing head includes a base, at least one resilient member attached to the base, and at least one processing member attached to the at least one resilient member.

One or more processing members can be selected based on the desired processing operation to be performed on a lapping plate platen. For example, a processing member can contact the major surface of the lapping plate platen under pressure to modify the surface of the lapping plate platen during the manufacture of the abrasive surface on the major surface of the lapping plate platen. Nonlimiting examples of proceeding members include one or more blades for shaving, one or more (e.g., 3 to 8, or even 3 to 6) charging elements (e.g., bars and/or rings) for charging abrasive particles into the lapping plate platen, combinations of these, and the like.

A resilient member according to the present disclosure can be selected to permit the at least one processing member to elastically move in response to a pressure increase while the at least one processing member is in contact the major surface of the lapping plate platen under pressure to modify the surface of the lapping plate platen during the manufacture of the abrasive surface on the major surface of the lapping plate platen. A resilient member can help distribute pressure to reduce or prevent local imbalances across the interface between a processing member and a surface of a lapping platen that the processing member is in contact with. Advantageously, by distributing pressure damage to the lapping plate platen can be reduced or eliminated. Also, a resilient member can allow a processing member such as a charging element (e.g., bar or ring) to conform to surface irregularities that may be present so as to help maintain contact between the charging element surface and platen surface. Maintaining contact can help charge small, abrasive particles into a platen surface having relatively low surface roughness, which can translate into good performance of a lapping plate platen during lapping. In some embodiments, a resilient member can also permit a processing head to gimble about its ball pin so that a processing head can float at a close clearance above the lapping plate platen in a manner to accommodate any irregularities in the top surface of a lapping plate platen (e.g., defects in surface finish) and/or lapping plate platens having a curved top surface (e.g., concave). If desired, processing members (e.g., a shaving blade or charging ring) that are rigidly fixed to a base of a processing head can be avoided. In some embodiments, when a processing member is rigidly fixed to a base of a processing head and the processing member encounters an irregularity in topography and/or an area depleted of lubrication local areas of high pressure can occur causing stiction, tilt/tip, and/or even a crash, which can cause damage to a platen and/or machine.

The portion of a resilient member that is between the base and a processing member can be made out of wide variety of elastomeric materials that can permit the processing member to elastically move in response to a pressure increase (deform) while the at least one processing member is in contact the major surface of the lapping plate platen under pressure and return to its original shape when the pressure is reduced or released. In some embodiments, the portion of a resilient member that is between the base and a processing member can be a rubber member. An example of such a rubber member is a vibration damping sandwich mount commercially available from McMaster-Carr® having part number 9232K13.

Examples of positioning a resilient member between the base and the processing member are described with FIGS. 4A-5B.

An example of a blade as a processing member is discussed below with respect to FIGS. 4A and 4B. A blade can be used to remove material ("shave") from a major surface of a lapping plate platen while the blade is in contact with the major surface of the lapping plate platen. Material can be removed from the top surface of a lapping plate platen during "shaving" to correct global plate deviations that may be present due to, e.g., imperfect cutting, profiling, and the like. Material can also be removed from the top surface of a lapping plate platen during "shaving" to help provide a smooth surface for charging abrasive particles into the surface.

Figure 4A:
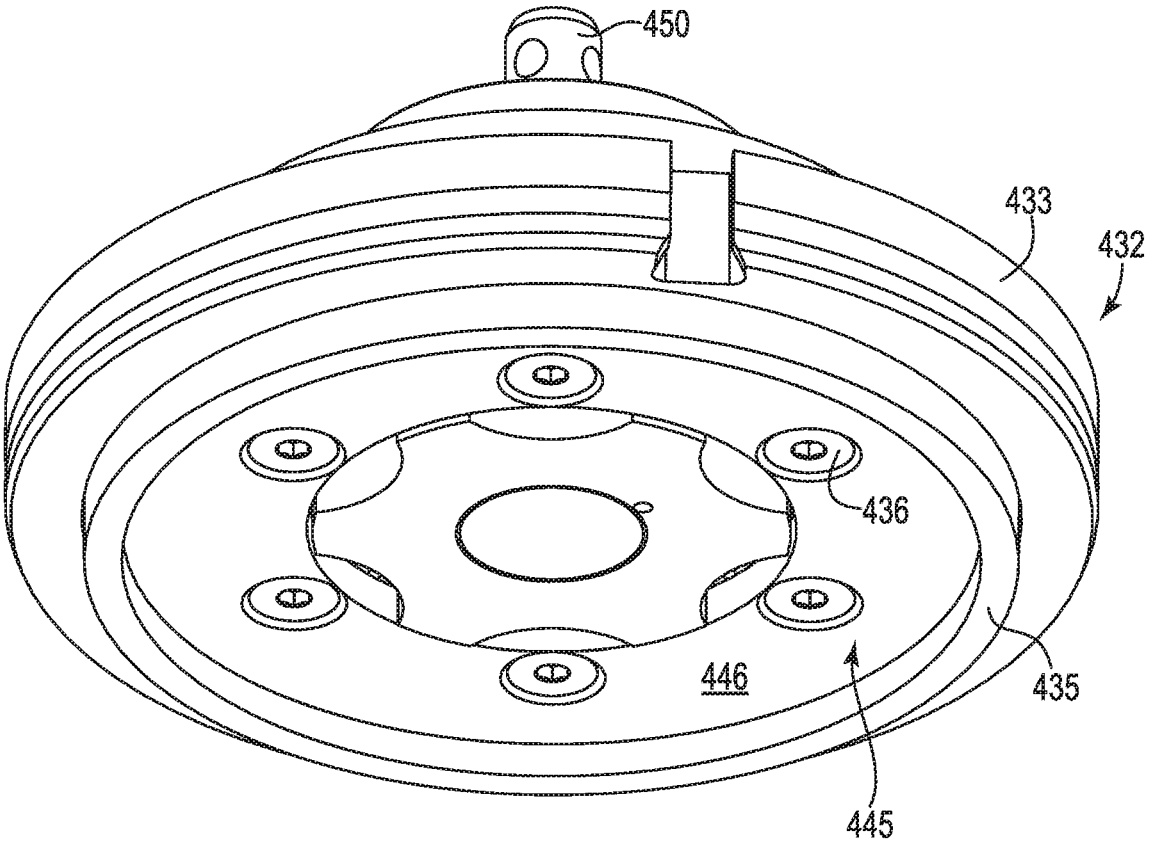
FIG. 4A perspective view of an embodiment of a processing head that includes a shaving blade as a processing member.

As shown in FIG. 4A, processing head 432 includes a base 433 and processing member 445 attached to base 433 via six threaded bolts 436. FIG. 4B is a cross-sectional view of processing head 432. As shown in FIGS. 4A and 4B, six resilient members 434 are attached to base 433 via threaded connections. Each resilient member 434 includes a shaft 440 having male threads. Base 433 has six through-holes 442 so that each through-hole 442 can receive a shaft 440. The male threads on shaft 440 can thread to female threads of nut 443. Each resilient member 434 also includes a rubber portion 441 that is between base 433 and processing member 445. Processing member 445 includes an annular plate 446 having six through-holes 447 that permit six threaded bolts 436 to be screwed into a female threaded insert in each resilient member 434. As shown, processing member 445 also includes one continuous blade 435 that can contact and shave a lapping plate platen. Blade 435 can be made out of a wide variety of materials for shaving a lapping plate platen. In some embodiments, blade 435 can be made out of material including tungsten carbide.

Figure 4B:
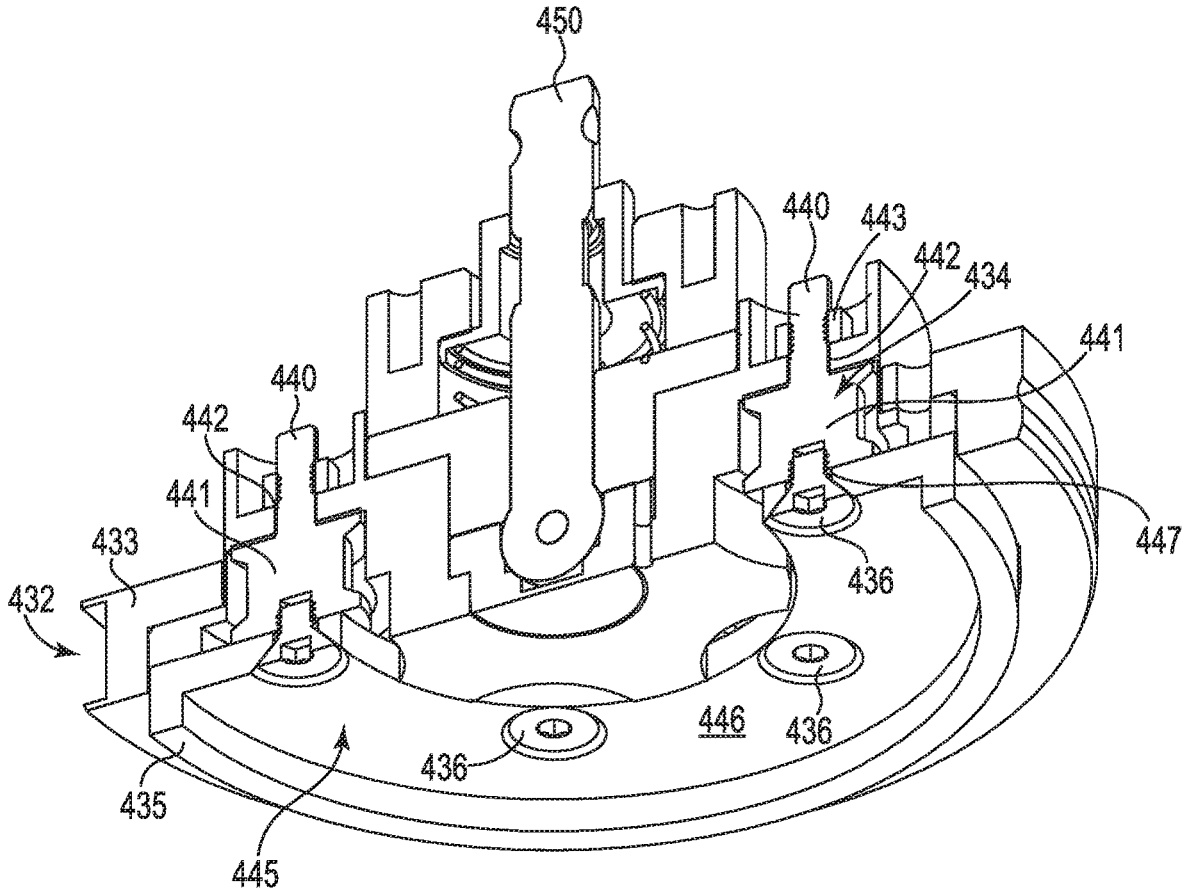
FIG. 4B is a cross-sectional view of the processing head shown in FIG. 4A.

As shown in FIG. 4B, a ball pin 450 is attached to processing head 432 to facilitate coupling processing head 432 to a processing head mechanism such as processing head mechanism 130 discussed above with respect to FIG. 1. In some embodiments, a resilient member 434 can also permit a processing head to gimble about its ball pin 450 so that processing head 432 can float at a close clearance above a lapping plate platen in a manner to accommodate lapping plate platens having a curved top surface (e.g., concave).

An example of a charging ring as a processing member is discussed below with respect to FIGS. 5A and 5B. A charging ring can be used to force abrasive particles into (embed) the major surface of the lapping plate platen while the charging ring is in contact with the major surface of the lapping plate platen. Embedding abrasive particles into a lapping plate to form an abrasive surface is a process that can be referred to as "charging."

Figure 5A:
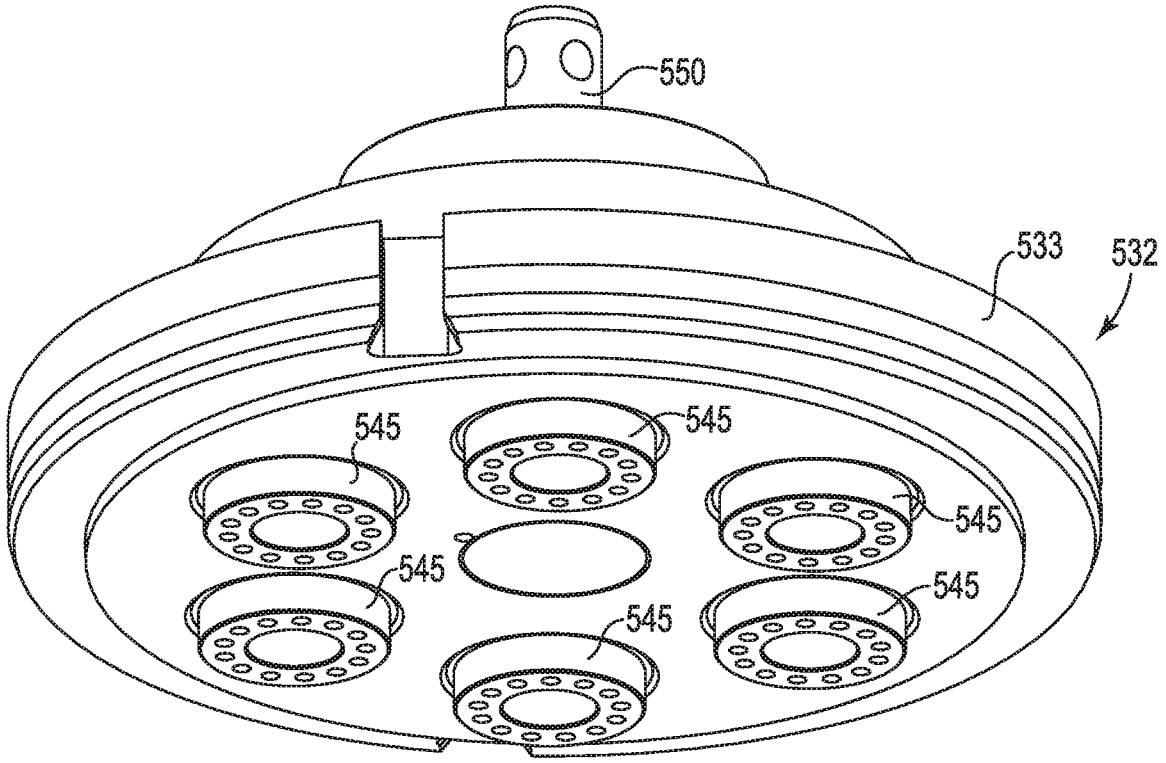
FIG. 5A perspective view of an embodiment of a processing head that includes six charging rings as a processing member.
Figure 5B:
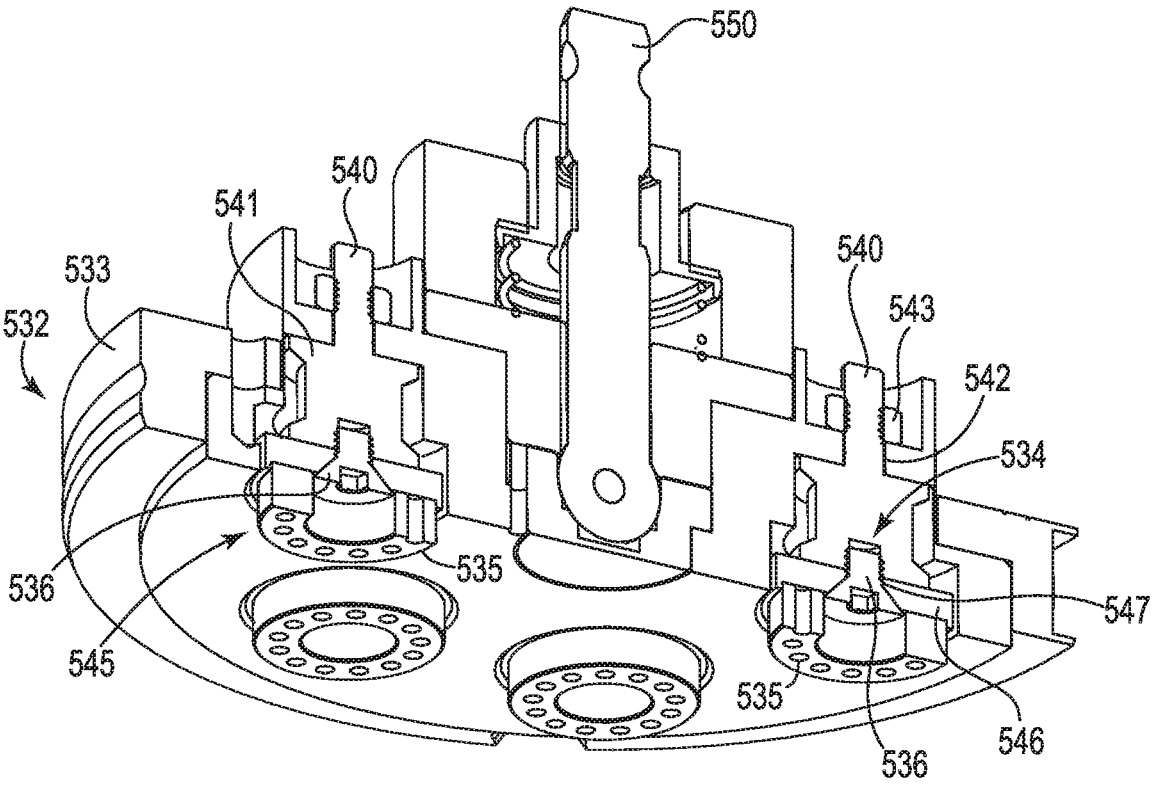
FIG. 5B is a cross-sectional view of the processing head shown in FIG. 5A.

As shown in FIGS. 5A and 5B, processing head 532 includes a base 533 and six processing members 545 attached to base 533 via six threaded bolts 536. FIG. 5B is a cross-sectional view of processing head 532. As shown in FIG. 5B, a resilient member 534 is attached to base 533 via a threaded connection. Each resilient member 534 includes a shaft 540 having male threads. Base 533 has six through-holes 542 so that each through-hole 542 can receive a shaft 540. The male threads on a shaft 540 can thread to female threads of a nut 543. Each resilient member 534 also includes a rubber portion 541 that is between base 533 and each processing member (charging ring) 545. As shown, each charging ring 545 includes a plate 546 having a through-hole 547 that permits a threaded bolt 536 to be screwed into a female threaded insert in resilient member 534. Each processing member 545 also includes a puck-like charging ring 535 that can contact a lapping plate platen and force abrasive particles into (embed) the major surface of the lapping plate platen while the charging ring is in contact with the major surface of the lapping plate platen.

Each charging ring 535 can be made out of a wide variety of materials for charging abrasive particles into a lapping plate platen. In some embodiments, a charging ring 535 can be made out of material zirconia toughened alumina (ZTA). While six charging rings 535 are shown in FIGS. 5A and 5B, any number of charging rings can be used as desired. For example, one or more, three or more, or even six or more charging rings could be included in a single processing head.

The size of each charging ring can be selected as desired. In some embodiments, a charging head can have a diameter in the range from 0.5 to 3 inches.

A resilient member 534 can permit the corresponding charging ring 535 to elastically move in response to a pressure increase while the charging ring is in contact the major surface of the lapping plate platen under pressure to charge abrasive particles into the surface of the lapping plate platen. A resilient member can help distribute pressure to reduce or prevent local imbalances across the interface between a charging ring and a surface of a lapping platen that the charging ring is in contact with. Advantageously, each resilient member 534 can allow the each corresponding charging ring 535 to conform to surface irregularities that may be present so as to help maintain contact between the ring surface and platen surface. Maintaining contact can help charge relatively small, abrasive particles into a platen surface having relatively low surface roughness, which can translate into good performance of a lapping plate platen during lapping. For example, when the surface roughness of a lapping plate platen is on the order of the size of the abrasive particles, it can difficult to charge the abrasive particles into the lapping plate platen if the charging ring does not maintain contact with the lapping plate platen. For illustration purposes, charging abrasive particles 50 nanometers in size can be challenging if the surface roughness of the lapping plate platen is 20 nanometers and the charging rings do not maintain suitable contact with the lapping plate platen.

As shown in FIG. 5B, a ball pin 550 is attached to processing head 532 to facilitate coupling processing head 532 to a processing head mechanism such as processing head mechanism 130 discussed above with respect to FIG. 1. In some embodiments, a resilient member 534 can also permit a processing head 532 to gimble about its ball pin 550 so that a processing head 532 can float at a close clearance above a lapping plate platen in a manner to accommodate any irregularities in the top surface of the lapping plate platen (e.g., defects in surface finish) and/or lapping plate platens having a curved top surface (e.g., concave).

If desired, charging rings that are rigidly fixed to a base of a processing head can be avoided. In some embodiments, when a charging ring is rigidly fixed to a base of a processing head and the charging ring encounters an irregularity in topography and/or an area depleted of lubrication local areas of high pressure can occur causing stiction, tilt/tip, and/or even a crash, which can cause inconsistent charging of abrasive particles to an undue degree, and/or damage to a platen and/or machine.

Figure 3:
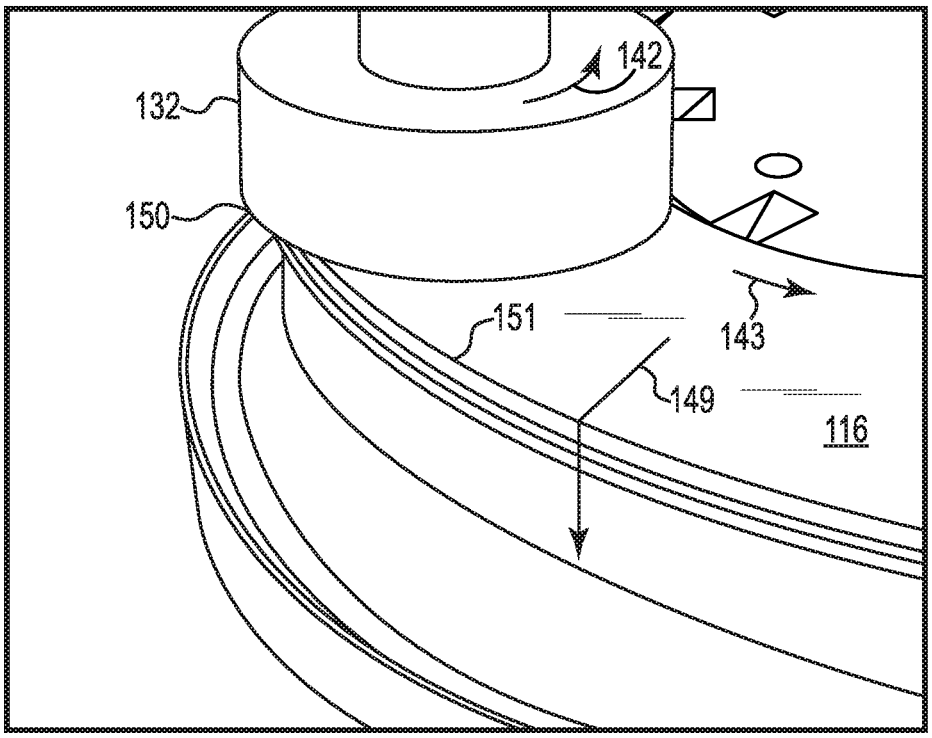
FIG. 3 is a partial, perspective view of the apparatus shown in FIG. 1.

An example of "charging" the surface 116 with a slurry of diamond particles to form a charged lapping surface is described herein below in connection with apparatus 100, where processing head 532 shown in FIGS. 5A and 5B is an example of a charging processing head 132 shown in FIGS. 1-3. "Charging" refers to a process of embedding abrasive particles from a suspension in a liquid into the surface 116 of platen 114.

Abrasive particles can be made out of one or more materials. In some embodiments, abrasive particles are selected from the group consisting of diamond particles, cubic boron nitride particles, alumina particles, alumina zirconia particles, silicon carbide particles, and combinations thereof. In some embodiments, abrasive particles can have an average particle diameter of 200 nanometers or less, 100 nanometers or less, 75 nanometers or less (e.g., from 5 to 70 nanometers), 60 nanometers or less, or even 50 nanometers or less. In some embodiments, the surface of the lapping plate platen has a surface roughness of 100 nanometers or less, or even 50 nanometers or less.

Charging can be performed using a processing head 132 in combination with an abrasive charging slurry dispensed from dispensing unit 138. Specifically, as discussed above, pneumatics or predetermined weights (not shown) can be coupled with each arm 128 and head 132 so that the head 132 applies a predetermined amount of pressure to the surface 116 of platen 114 to help embed the diamond particles contained in the slurry into the lapping surface 116. In addition to rotating platter 112 and platen 114 as indicated by arrow 143, a processing head 132 can be rotated as indicated by arrow 142 for a period of time to embed a desired amount of abrasive particles into the surface 116. It is noted that rotating platter 112 and head 132 are not restricted to a particular direction of rotation.

Charging can be performed under a variety of rotatable platter 112 speeds and for a variety of time periods. Charging can be performed for a time period to produce a dense and even coverage of abrasive particles in surface 116. For example, charging can be performed for a time period in the range from 5 to 120 minutes. The rotational speed of the rotatable platter can be in a range from about 10 to 60 rpms to allow the abrasive particles to become fully embedded within the surface 116. The rotational speed of the processing head 132 can also be in a range from about 10 to 60 rpm.

In some embodiments, charging can be performed under constant conditions. Accordingly, rotational velocity of the charging head 132, pressure, and slurry concentration can be accurately controlled.

In one embodiment, head 132 is lowered relative to surface 116 so that head 132 is in contact with surface 116 while having a prescribed amount of weight forcing rings 146 into contact with surface 116 under a prescribed amount of pressure. During charging, the head 132 can rotate counter-clockwise as indicated by arrow 142, and the platen 114 and rotatable platter 112 can rotate counter-clockwise as indicated by arrow 143. A slurry containing abrasive particles such as diamond particles can be discharged onto surface 116 via one or more dispensing units such as dispensing unit 138 discussed above. As the slurry contacts the surface 116, charging rings such as rings 535 in FIGS. 5A and 5B drive the diamond particles into surface 116 so that the particles become fixed to the surface 116 so as to form an abrasive surface for lapping operations.

What is claimed is:

1. An apparatus for processing a major surface of a lapping plate platen during the manufacture of an abrasive surface on the major surface of the lapping plate platen, wherein the apparatus comprises:

a) a rotatable platter configured to secure and physically support the lapping plate platen during processing of the major surface of the lapping plate platen;

b) a processing head mechanism that is rotatably and removably coupled to a processing head, wherein the processing head comprises:

i) a base;

ii) at least three resilient members attached to the base; and iii) at least three processing members, wherein each processing member is attached to a corresponding resilient member, wherein each resilient member comprises a shaft, wherein the base comprises at least three corresponding through-holes to receive the shaft so that each resilient member is physically coupled to the base, wherein each resilient member is physically coupled to the base via a threaded connection, wherein each processing member can contact the major surface of the lapping plate platen under pressure to modify the surface of the lapping plate platen during the manufacture of the abrasive surface on the major surface of the lapping plate platen, wherein each resilient member permits the corresponding processing member to elastically move in response to a pressure increase while the corresponding processing member is in contact the major surface of the lapping plate platen under pressure to modify the surface of the lapping plate platen during the manufacture of the abrasive surface on the major surface of the lapping plate platen, and wherein the apparatus is configured to move the processing head to contact the major surface of the lapping plate platen with the at least three processing members under pressure while the processing head and the lapping plate platen rotate to modify the surface of the lapping plate platen during the manufacture of the abrasive surface on the major surface of the lapping plate platen.

2. The apparatus of claim 1, wherein the at least three resilient members comprise a rubber member.

3. The apparatus of claim 1, wherein the at least three processing members comprise at least three charging elements to force abrasive particles into the major surface of the lapping plate platen while the charging elements are in contact with the major surface of the lapping plate platen.

4. The apparatus of claim 3, wherein the at least three charging elements comprise at least three charging rings.

5. The apparatus of claim 4, wherein the at least three charging rings are made out of material comprising zirconia toughened alumina (ZTA).

6. The apparatus of claim 4, wherein each charging ring has a diameter in the range from 0.5 to 3 inches.

7. The apparatus of claim 3, wherein the at least three charging elements comprise at least three charging bars.

8. The apparatus of claim 1, wherein each resilient member comprises elastomeric material.

9. The apparatus of claim 3, wherein the at least three charging elements comprise three to eight charging rings.

10. The apparatus of claim 1, wherein the rotatable platter and processing head are configured to rotate in the same direction.

11. The apparatus of claim 1, wherein the processing head rotates about a first axis and the lapping plate platen rotates about a second axis, wherein the first axis is parallel to and offset from the second axis.

12. The apparatus of claim 1, wherein each processing member is coupled to each corresponding resilient member via a threaded connection.

13. The apparatus of claim 1, wherein the processing head is coupled to the processing head mechanism via a ball pin.

14. An apparatus for processing a major surface of a lapping plate platen during the manufacture of an abrasive surface on the major surface of the lapping plate platen, wherein the apparatus comprises:

a) a rotatable platter configured to secure and physically support the lapping plate platen during processing of the major surface of the lapping plate platen;

b) a processing head mechanism that is rotatably and removably coupled to a processing head, wherein the processing head comprises:

i) a base;

ii) at least three resilient members attached to the base; and iii) at least three processing members, wherein each processing member is attached to a corresponding resilient member, wherein the at least three processing members comprise at least three charging elements to force abrasive particles into the major surface of the lapping plate platen while the charging elements are in contact with the major surface of the lapping plate platen, wherein the at least three charging elements comprise three to eight charging rings, wherein each resilient member comprises a shaft, and wherein the base comprises a corresponding through-hole for each shaft to receive the shaft so that the corresponding resilient member is physically coupled to the base via threaded connection, wherein each processing member can contact the major surface of the lapping plate platen under pressure to modify the surface of the lapping plate platen during the manufacture of the abrasive surface on the major surface of the lapping plate platen, wherein each resilient member permits the corresponding processing member to elastically move in response to a pressure increase while the corresponding processing member is in contact the major surface of the lapping plate platen under pressure to modify the surface of the lapping plate platen during the manufacture of the abrasive surface on the major surface of the lapping plate platen, and wherein the apparatus is configured to move the processing head to contact the major surface of the lapping plate platen with the at least three processing members under pressure while the processing head and the lapping plate platen rotate to modify the surface of the lapping plate platen during the manufacture of the abrasive surface on the major surface of the lapping plate platen.

15. The apparatus of claim 14, wherein each processing member is coupled to each corresponding resilient member via a threaded connection.

16. The apparatus of claim 14, wherein the processing head is coupled to the processing head mechanism via a ball pin.

17. The apparatus of claim 14, wherein the at least three resilient members comprise a rubber member.

18. The apparatus of claim 14, wherein each resilient member comprises elastomeric material.

19. The apparatus of claim 14, wherein the rotatable platter and processing head are configured to rotate in the same direction.

20. The apparatus of claim 14, wherein the processing head rotates about a first axis and the lapping plate platen rotates about a second axis, wherein the first axis is parallel to and offset from the second axis.

* * * * *